US007832962B1

(12) United States Patent
Andreyev et al.

(10) Patent No.: US 7,832,962 B1
(45) Date of Patent: Nov. 16, 2010

(54) SAND SLURRY INJECTION SYSTEMS AND METHODS

(75) Inventors: Nicolas E. Andreyev, Sanford, FL (US); Koons William, Grand Island, FL (US)

(73) Assignee: Andreyev Engineering Independent Drilling, LLC, Sanford, FL (US)

( * ) Notice: Subject to any disclaimer, the term of this patent is extended or adjusted under 35 U.S.C. 154(b) by 145 days.

(21) Appl. No.: 12/234,064

(22) Filed: Sep. 19, 2008

(51) Int. Cl.
*E02D 3/00* (2006.01)

(52) U.S. Cl. ..... 405/302.4; 405/269; 405/267

(58) Field of Classification Search ..... 405/263, 405/264, 265, 266, 267, 268, 269, 270
See application file for complete search history.

(56) References Cited

U.S. PATENT DOCUMENTS 4,229,122 A * 10/1980 Ballantyne ..... 405/266
4,303,438 A * 12/1981 Zaslavsky et al. ..... 405/264
4,366,074 A * 12/1982 McLaughlin et al. ..... 405/264
4,606,675 A * 8/1986 Mitani et al. ..... 405/263
4,787,453 A * 11/1988 Hewgill et al. ..... 405/264
4,883,125 A * 11/1989 Wilson et al. ..... 166/291
4,968,187 A * 11/1990 Burnett ..... 405/269
5,407,909 A * 4/1995 Goodhue et al. ..... 405/263
5,454,668 A * 10/1995 Liao ..... 405/117
5,663,123 A * 9/1997 Goodhue et al. ..... 507/225
5,741,090 A * 4/1998 Dunning et al. ..... 405/263
6,168,352 B1 * 1/2001 Chen et al. ..... 405/266
6,248,697 B1 * 6/2001 Goodhue et al. ..... 405/267

OTHER PUBLICATIONS

S. Barfield and N. Andreyev, Sinkholes and the Engineering and Environmental Impacts of Karst (GSP 183), Proceedings of the Eleventh Multidisciplinary Conference, ASCE Conference Proceedings (2008), available at http://scitation.aip.org/getabs/servlet/GetabsServlet?prog=normal&id=ASCECP00032704, at least as of Aug. 11, 2009.

* cited by examiner

*Primary Examiner*—Frederick L Lagman
(74) *Attorney, Agent, or Firm*—Kilpatrick Stockton LLP

(57) ABSTRACT

A sand slurry injection system and/or method can include mixing a drilling mud inhibitor with water to form a water mixture; mixing the water mixture with sand to form a sand slurry; and injecting the sand slurry into an unstable ground subsurface area to stabilize the area. The water mixture can be pumped under pressure into the bottom and/or into the middle of the hopper to help maintain the sand slurry in suspension. The water mixture can be pumped into two opposed injection ports at each of the bottom and the middle of the hopper. The two upper injection ports can be oriented at a 90 degree angle from the two bottom injection ports.

21 Claims, 4 Drawing Sheets

SAND SLURRY INJECTION SYSTEMS AND METHODS

FIELD OF THE INVENTION

The present invention relates to sand slurry injection systems and methods. Embodiments of the present invention may be useful for remediating unstable ground subsurface conditions.

BACKGROUND

Areas of ground subsurface can become unstable due to a variety of conditions. Subsurface, or underground, instability can be caused by natural phenomena. For example, a ground subsurface area can develop cavities or very loose soil conditions, which can be caused by events such dissolution of limestone or internal erosion of earthen materials or by flooding. Subsurface instability may also be related to man-made conditions. For example, removal of earthen material for constructing a structure such as a road or building and/or pumping well activity may lead to sinkhole formation. Sinkholes can result in damage to and/or collapse of structures such as a road. Another example of subsurface instability is raveling, or separating, of geologic layers that can occur underneath storm ponds. Subsurface instability can also occur in areas around other storm water structures. Such unstable subsurface conditions often require stabilization. Stabilization of subsurface conditions can be particularly critical in areas having predominantly sandy soil.

A conventional approach to stabilizing unstable subsurface conditions is injection of a concrete grout into the unstable area. Concrete grout is often used to stabilize unstable subsurface conditions, such as a sinkhole, in sandy soil. Stabilizing subsurface areas with concrete grout can have disadvantages. For example, hardened concrete can impede normal seepage of water through a repaired subsurface. Concrete can introduce an undesirable processed material, in particular cement, into the environment. Another disadvantage is that subsurface injection of concrete can "grout in" buried utilities or other underground structures that make access to such utilities or structures difficult, if not impossible. In addition, underground injection of concrete can be complicated and involve significant cost.

Thus, there is a need to provide systems and methods for stabilizing subsurface areas while overcoming the disadvantages of injecting concrete grout into such areas.

SUMMARY

Some embodiments of the present invention can include sand slurry injection systems and/or methods. Embodiments of the present invention may be useful for stabilizing unstable ground subsurface conditions.

Some embodiments can include a method comprising mixing a drilling mud inhibitor with water to form a water mixture; mixing the water mixture with sand to form a sand slurry; and injecting the sand slurry into an unstable ground subsurface area to stabilize the area. The sand slurry can be maintained in suspension in the hopper until the sand slurry is injected into the unstable ground subsurface area. For example, the sand can be placed into a sand hopper having a top, a bottom, and a middle between the top and bottom; and the water mixture can be pumped under pressure into the bottom of the hopper to help maintain the sand slurry in suspension. Certain embodiments can further include pumping the water mixture under pressure into the middle of the hopper. In certain embodiments, the water mixture can be pumped into two opposed injection ports at each of the bottom and the middle of the hopper. In particular embodiments, the two upper injection ports can be oriented at a 90 degree angle from the two bottom injection ports.

Some embodiments can include a system comprising a water mixture comprising a drilling mud inhibitor mixed with water; a water pump adapted to pump the water mixture under pressure into a sand hopper containing sand to form a sand slurry; and a sand slurry pump adapted to pump the sand slurry under pressure into an unstable ground subsurface area to stabilize the area. The sand hopper can have a top, a bottom, a middle between the top and bottom, and two opposed injection ports at the bottom of the hopper configured to receive the pressurized water mixture. In some embodiments, the sand hopper can further include two opposed injection ports at the middle of the hopper configured to receive the pressurized water mixture. In certain embodiments, the two opposed injection ports at the middle of the hopper can be oriented at a 90 degree angle from the two opposed injection ports at the bottom of the hopper.

In a particular embodiment of such a system, the sand hopper can further comprise an approximately four foot by four foot, substantially square top; four sides extending from the top and angled inwardly to a bottom in a funnel shape; an approximately four inch by four inch, substantially square bottom outlet; and a hopper delivery pipe connected on one end to the bottom outlet and connectable on the other end to the sand slurry pump. The sand hopper may further include a bottom frame attached to the bottom of the sand hopper, thereby providing a space for the hopper delivery pipe.

In some embodiments of a system and/or method, the water—drilling mud inhibitor mixture may provide viscosity and lubrication to the sand slurry. In certain such embodiments, the drilling mud inhibitor can comprise a high molecular weight polymer emulsion. In certain embodiments of a system and/or method, the water can be substantially free of solids. In certain embodiments of a system and/or method, the sand can be natural, fine and/or medium grain size sand substantially free of debris.

In some embodiments of a system and/or method, the sand slurry can be injected, or pumped, into an unstable subsurface area with a progressing cavity sand slurry pump. Some embodiments of a system and/or method can further include a high pressure hose securely connectable from the sand slurry pump to a subsurface delivery pipe configured to deliver the sand slurry to the unstable ground subsurface area.

Features of sand slurry injection systems and/or methods may be accomplished singularly, or in combination, in one or more of the embodiments of the present invention. As will be realized by those of skill in the art, many different embodiments of sand slurry injection systems and/or methods are possible. Additional uses, advantages, and features of aspects of the present invention are set forth in the illustrative embodiments discussed in the detailed description herein and will become more apparent to those skilled in the art upon examination of the following.

DETAILED DESCRIPTION

Figure 1:
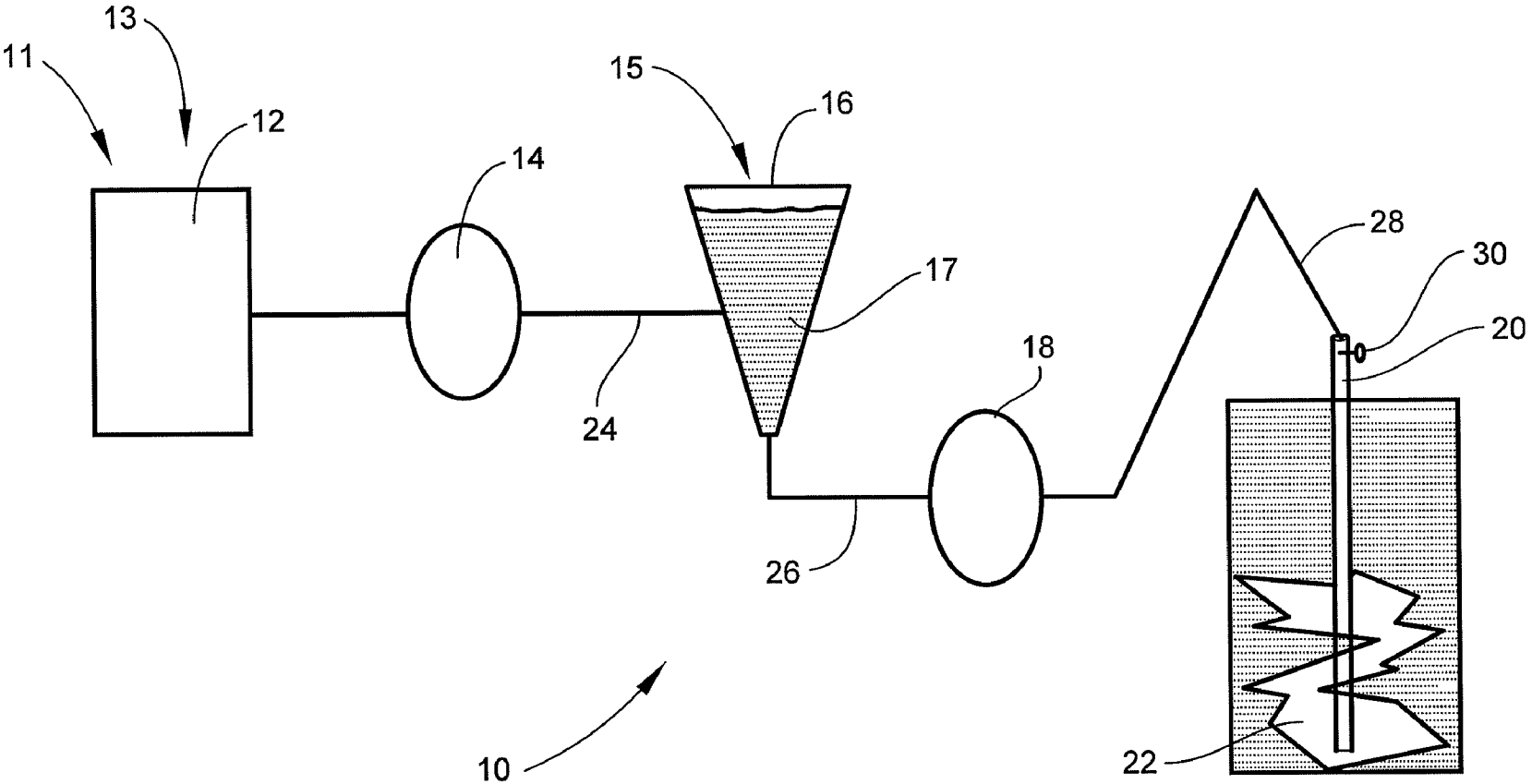
FIG. 1 is a schematic view of a subsurface sand slurry injection system and method in an embodiment of the present invention.

For the purposes of this specification, unless otherwise indicated, all numbers expressing quantities, conditions, and so forth used in the specification are to be understood as being modified in all instances by the term "about." Accordingly, unless indicated to the contrary, the numerical parameters set forth in the following specification are approximations that can vary depending upon the desired properties sought to be obtained by the embodiments described herein. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the described embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, for example, 5.5 to 10. Additionally, any reference referred to as being "incorporated herein" is to be understood as being incorporated in its entirety.

As used in this specification and the appended claims, the singular forms "a," "an," and "the" include plural referents unless the context clearly dictates otherwise. Thus, for example, the term "an injection port" is intended to mean a single injection port or more than one injection port.

Some embodiments of the present invention can include sand slurry injection systems and methods. Some embodiments of a sand slurry injection system and/or method can be utilized as a alternative to concrete grout injection, and may be particularly useful in remediating certain subsurface instabilities. Such instabilities can include sinkholes, raveled, or separated, zones, extremely loose soil zones, and/or cavities. For example, some embodiments of a sand slurry injection system and/or method can be effectively utilized for stabilizing large sinkhole cavities, sinkhole activity created by pumping wells, and sinkhole related collapses of surface structures such as roads. Certain embodiments can be used to repair raveled and/or collapsed subsurface conditions near storm water ponds and around pumping wells and/or to stabilize storm water structures. Some embodiments of the sand slurry injection system and/or method can provide for subsurface stabilization in a manner similar to concrete grout injection, while providing other benefits not possible with the concrete grout method.

In an illustrative embodiment as shown in FIG. 1, a sand slurry injection system 10 and/or method 60 can include a water tank 12 and a sand hopper 16. A water pump 14 can inject, or pump, water 11 under pressure from the water tank 12 to the sand hopper 16, where sand 15 can be mixed with the water 11, or a water mixture, to form a sand slurry 17. The sand slurry 17 can then be pumped by a sand slurry pump 18 from the hopper 16 to a target unstable subsurface area 22 for stabilizing the subsurface area 22.

The water tank 12 have a variety of constructions and sizes, depending on factors of convenience for holding and delivering water 11 to a work site for remediating the unstable subsurface area 22. For example, the tank 12 can be a 1,000 gallon water tank on wheels for portability to a work site.

In some embodiments, the water 11 in the tank 12 can be mixed with an inhibitor 13 known as "drilling mud" to form a water mixture. For purposes herein, "drilling mud," or "drilling fluid," is defined as a chemical composition which, in combination with mud and/or sand, can stabilize certain subsurface materials, such as shale and clay. In addition, a drilling mud can enhance the rheological, or flow, properties of the sand slurry 17. For example, in certain embodiments, the drilling mud inhibitor 13 can provide added viscosity and lubrication to the sand slurry 17, which improves suspension of the sand 15 in the hopper 16. A drilling mud can be a water-based drilling mud, a non-aqueous, or oil-based drilling mud, or a gaseous or pneumatic drilling mud.

One embodiment of a drilling mud 13 useful in systems and/or methods of the present invention is EZ-MUD® PLUS, available from Baroid Industrial Drilling Products, 3000 N. Sam Houston Pkwy. E., Houston, Tex. 77032. EZ-MUD® PLUS is a high molecular weight polymer emulsion containing partially hydrolyzed polyacrylamide/polyacrylate (PHPA) copolymer. EZ-MUD® PLUS can be used as a viscosifier useful in preventing reactive shales and clays from swelling and sloughing in a subsurface area being stabilized. In particular embodiments, about one quart of EZ-MUD® PLUS drilling mud inhibitor 13 can be mixed with each 100 gallons of water 11 (or about 2.5 liters of drilling mud inhibitor 13 per cubic meter of water 11) to provide the sand slurry 17 having desirable flow and stabilizing properties. The ratio of drilling mud inhibitor 13 to water 11 can be adjusted as needed to obtain desirable end properties in the water mixture. In other embodiments, equivalent or similar drilling mud inhibitors 13 can be mixed with the water 11. The water 11 can be any clean potable or surface water 11 that is substantially free of contaminants and solids.

The amount of water 11 needed for an optimal sand slurry mixture 17 depends on factors including, for example, the type of sand 15 and the natural moisture of the sand 15. For example, in some embodiments in which natural dry sand (having a moisture content of about 5%-7%) is used, the amount of water 11 needed to prepare an optimal sand slurry mixture 17 can be about two gallons of water, or water mixture, 11 per cubic foot of the sand 15.

As shown in the embodiment in FIG. 1, the water mixture can be pumped under pressure, or injected, from the water tank 12 to the sand hopper 16 where the water mixture and sand 15 can be mixed to form the sand slurry 17. The water pump 14 can be of various sizes and capacities depending on volume and pressure of water mixture injection needed to adequately mix the water mixture and the sand 15 in the sand hopper 16. For example, in an embodiment in which the sand hopper 16 comprises a funnel-shaped hopper having a four foot by four foot top, the water pump 14 can be in the range of about six to eight horse power, and have a pressure capacity of at least 20 pounds per square inch (PSI). The water pump 14 can be either gas or electric powered, depending on the availability of power source at a work site and/or design preference.

Figure 3:
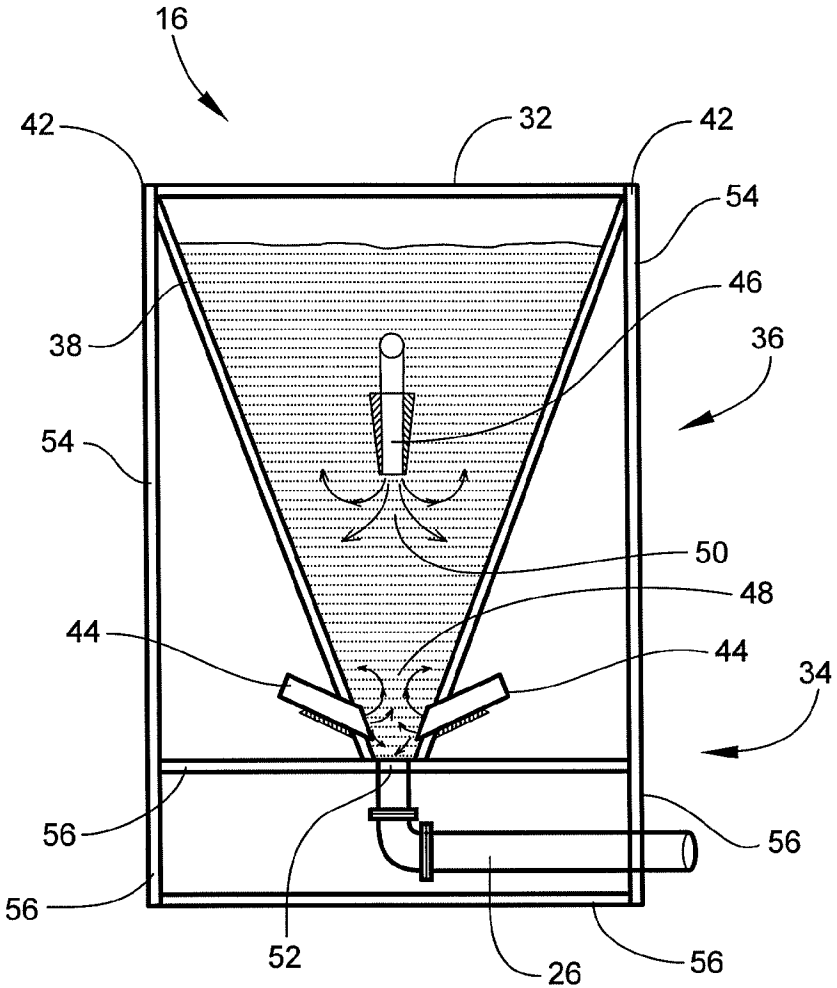
FIG. 3 is a cross-sectional view along lines 3-3 of the sand slurry hopper shown in FIG. 2.

The water pump 14 can be connected to the sand hopper 16 with one or more high pressure hoses 24, for example, hoses 24 having a capacity rating in the range of about 300-500 PSI. The high pressure hoses 24 can comprise various materials, for example, polyvinyl chloride (PVC) and/or vynol. The hoses 24 can be securely connected to the water tank 12 and to the sand hopper 16, for example, with cam lock connections. In some embodiments, the hoses 24 can be connected to the sand hopper 16 at least near the bottom 34 of the hopper 16. In certain embodiments, as shown in FIG. 3, the water pump 14 can pump the water mixture into at least two levels of the hopper 16, for example, near the bottom 34 and near the middle 36 between the top 32 and bottom 34 of the hopper 16. Pumping the water mixture into the bottom 34 and middle 36 of the hopper 16 allows dynamic mixing of the sand 15 and water mixture into the slurry 17.

Figure 2:
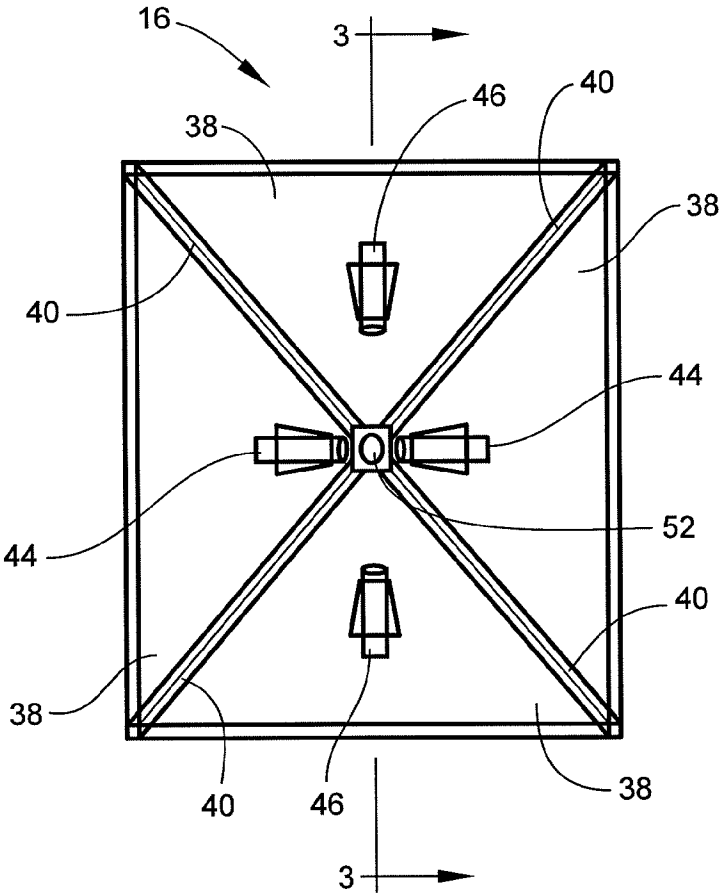
FIG. 2 is a top plan view of an embodiment of a sand slurry hopper useful in embodiments a method of the present invention.

One embodiment of the sand hopper 16 is shown in FIGS. 2 and 3. As shown in this embodiment, the sand hopper 16 can be configured for receiving sand and for mixing the sand 15 with the water 11 or water mixture into the sand slurry 17. The sand hopper 16 can comprise various configurations and dimensions, depending on factors, including, for example, a desired rate at which the sand 15 and water mixture are to be mixed and a desired rate at which the sand slurry 17 is to be delivered to the target unstable subsurface area 22. Testing of various configurations of the sand hopper 16 demonstrated that the embodiment shown in FIGS. 2 and 3 provides an optimal design in many instances for mixing the sand slurry 17 and delivering the sand slurry 17 to the unstable subsurface area 22.

As shown in FIGS. 2 and 3, the sand hopper 16 can include a top 32 and a bottom 34. In certain embodiments, the top 32 of the sand hopper 16 can be open so that sand 15 can be dumped directly into the hopper 16, for example, by a tractor loader. The top 32 can be larger than the bottom 34 such that the sides 38 of the hopper 16 are angled inwardly from the top 32 to the bottom 34 in a funnel shape. In a particular embodiment, the top 32 of the hopper 16 can be about a four foot by four foot square that reduces to a bottom outlet 52 of about a four inch by four inch square. A hopper 16 having a four foot by four foot top 32 can be sufficiently portable to transport to a work site and provide sufficient top area for loading in sand 15 with a small front end loader. In other embodiments, the hopper 16 can comprise other dimensions. As shown in FIGS. 2 and 3, the sides 38 of the sand hopper 16 can be triangular in shape and edges 40 of the sides 38 can be fixed to the edges 40 of adjacent sides 38, such as by welding. Alternatively, the sides 38 of the sand hopper 16 can have a rounded, or conical, shape without edges 40. The sides 38 of the sand hopper 16 can comprise various materials. For example, sides 38 of the sand hopper 16 can comprise one-fourth inch steel, which can be reinforced. Some embodiments of the sand hopper 16 can further include a vertical support bar 54 fixed to each of the top corners 42 of the hopper 16. The support bars 54 can extend vertically downward at the sides 38 of the hopper 16 to support the hopper 16 in an upright position. The support bars 54 can comprise the same material as the hopper sides 38, for example, steel.

In certain embodiments, the water pump 14 can pump the water mixture into at least two levels of the hopper 16, for example, near the bottom 32 and near the middle 36 between the top 32 and bottom 34 of the hopper 16. As shown in FIGS. 2 and 3, the sand hopper 16 can include a bottom injection port 44, or pipe, on each of opposite sides 38 near the bottom 34 of the hopper 16 and an upper injection port 46, or pipe, on each of opposite sides 38 near the middle 36 of the hopper 16. In certain embodiments, the pair of upper injection ports 46 can be oriented at a 90 degree angle from the pair of bottom injection ports 44. The high pressure hoses 24 from the water pump 14 can be securely connected to each of the injection ports 44, 46 to provide a pressurized, or jetted, inflow of the water mixture into the hopper 16. It was discovered through experimentation that two pairs of oppositely positioned injection ports 44, 46, one pair near the bottom 34 and one pair near the middle 36 of the hopper 16 can provide optimal mixing of the sand 15 and water mixture and keep the resulting sand slurry 17 in suspension in the hopper 16. Due to the weight of the sand 15 and water mixture, the bottom injection ports 44 provide a primary mixing zone 48, and the upper injection ports 46 provide a secondary mixing zone 50. Pumping the water mixture into the bottom 34 and middle 36 of the hopper 16 allows dynamic mixing of the sand 15 and water mixture into the slurry 17. The bottom injection ports 44 can provide a constant amalgamation in the slurry 17 of the sand 15, water 11, and drilling mud just prior to being conveyed through the remainder of the sand slurry injection system 10 and into the ground subsurface area 22. The drilling mud inhibitor in the water mixture can provide added viscosity and lubrication to the sand slurry 17, which can improve suspension of sand 15 in the hopper 16. The four port injection system configuration further facilitates delivery of the sand slurry 17 by gravity to the bottom 34 of the hopper 16.

As shown in FIG. 3, the hopper delivery pipe 26 can be connected on one end to the bottom outlet 52 of the sand hopper 16. The hopper delivery pipe 26 can be connected on its other end to the sand slurry pump 18 for transporting the sand slurry 17 to the target unstable subsurface area 22. The hopper delivery pipe 26 can have various dimensions. A three-inch pipe has been found to provide sufficient capacity for desired delivery of the sand slurry 17 in the sand hopper 16 to the sand slurry pump 26. The hopper delivery pipe 26 can comprise various materials, including, for example, PVC and/or vynol. In certain embodiments, the hopper delivery pipe 26 can be a high pressure hose having a pressure rating of, for example, 500 PSI. A bottom frame 56, for example, a series of connected steel bars, can be attached to the bottom 34 of the sand hopper 16. The bottom frame 56 can be attached to and/or extend from the hopper side support bars 54. The bottom frame 56 can provide a structured space to allow routing of the hopper delivery pipe 26 from the hopper bottom outlet 52 to the sand slurry pump 18.

Once the sand slurry 17 is mixed in the sand slurry hopper 16, the sand slurry pump 18 can pump the sand slurry 17 from the hopper 16 to the target subsurface area 22. The sand slurry pump 18 can have various features as long as it has sufficient capability to pump the sand slurry 17 from the hopper 16 to the target subsurface site 22. One pump suitable for this purpose is the Moyno one-frame pump, model 2L8, commercially available from Moyno, Inc., Springfield, Ohio 45501. The Moyno pump is a hydraulically operated, progressing cavity pump capable of providing low-flow and metered delivery of viscous materials to a site. Such a Moyno pump can be particularly useful for effective pumping of viscous materials have a high concentration of solids. The Moyno pump can further provide a smooth flow of material free from pulsations and variations in velocity and volume. This particular pump includes a hydraulic drive having a 1,500 PSI capacity that can generate 300 PSI pumping pressure. Other pumps can be utilized in the sand slurry injection system 10.

As shown in FIG. 1, the sand slurry injection system 10 can include a high pressure hose 28 securely connecting the sand slurry pump 18 to the subsurface delivery pipe 20. The high pressure 28 hose can be, for example, a two-wire breaded pressure hose having a 5,000 PSI rating. The subsurface delivery pipe 20 can comprise a steel casing used in subsurface drilling operations. A drill rig can be used to drill into the unstable subsurface area or zone 22. The steel casing can include one or more sections of three-inch inside diameter steel casing that are flush joint-threaded together. The steel casing delivery pipe 20 can be pushed or hammered to the desired depth into the unstable subsurface area 22 using disposable tips. Once the subsurface delivery pipe 20 is in a desired position, the sand slurry 17 can be pumped from the sand slurry hopper 16 through the high pressure hose 28 and through the subsurface delivery pipe 20 into the unstable subsurface area 22. A pressure gauge 30 can be attached to the injection point at the top of the subsurface delivery pipe 20 steel casing to monitor the flow pressure of the sand slurry 17 into the subsurface area 22.

Figure 4:
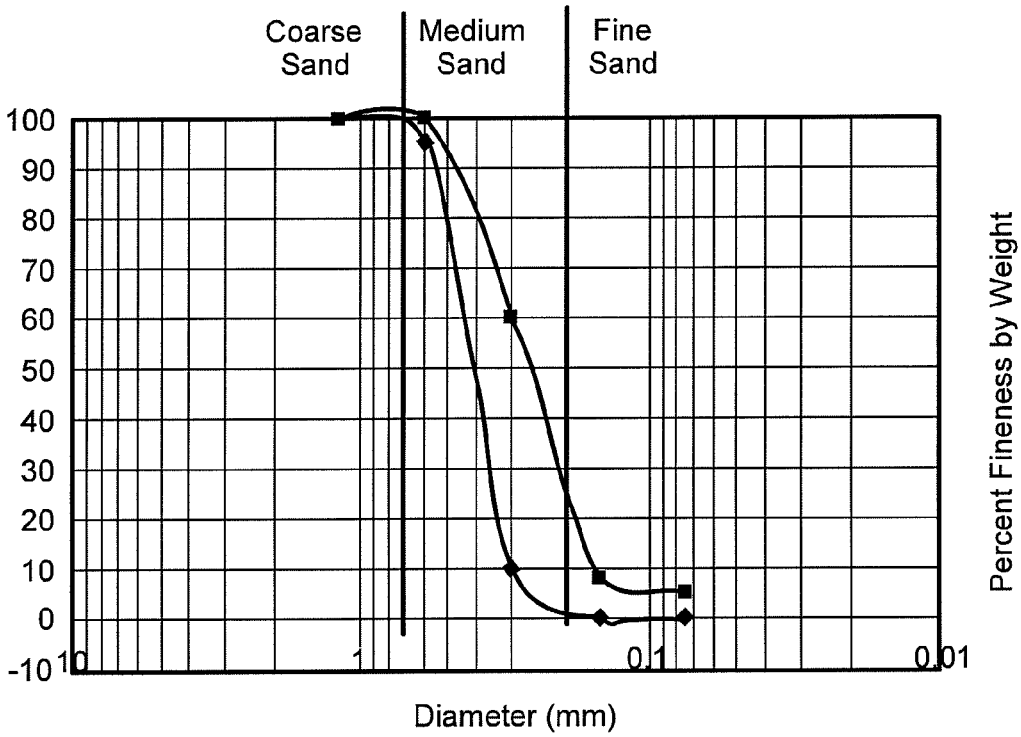
FIG. 4 is a chart showing the relationship of diameter to percent fineness by weight of sand useful in an embodiment of the present invention.

In embodiments of the sand slurry injection system 10 and method 60 of the present invention, the quality of the sand 15 can affect the efficiency of the process of making and delivering the sand slurry 17. In preferred embodiments, the sand 15 comprises natural fine and/or medium grain size sand 15. FIG. 4 provides a chart showing sand grain size distribution useful in embodiments of the present invention for creating the sand slurry 17 for remediating the unstable subsurface area 22. Grain size of the sand 15 is shown in terms of grain diameter (mm). Table 1 illustrates the percent range of total amount of sand 15 useful in some embodiments relative to the size of the sand grains. When sand 15 is passed through a sieve, all sand particles that are smaller than the sieve size (or opening between the sieve wires) pass through the sieve, and all particles larger than the sieve size remain in the sieve. Sieve filtering allows determination of the amount of sand particles that are smaller and larger than a particle sieve size. In a particular embodiment, the percentage of the total amount of sand 15 by weight comprising smaller grain sizes is relatively lower. The percentage of the total amount of sand 15 by weight comprising larger grain sizes is relatively higher. For example, in an illustrative embodiment, the preferred range of sand particles larger than sieve # 4 having a sieve opening of 4.76 mm is 100%. In illustrative embodiment, the preferred range of sand particles larger than sieve # 2004 having a sieve opening of 0.074 mm is 0%-5%.

TABLE 1

Sand Grain Size Distribution Ranges

| Sieve # | Sieve Size Opening (mm) | Preferred Range |
|---|---|---|
| 4 | 4.76 | 100%-100% |
| 8 | 2.38 | 100-100% |
| 16 | 1.19 | 100%-100% |
| 30 | 0.59 | 95%-100% |
| 50 | 0.297 | 10%-60% |
| 100 | 0.149 | 0%-8% |
| 200 | 0.074 | 0%-5% |

In preferred embodiments, the sand 15 should be clean and substantially free of rocks, roots, wood, and other debris. An example of a commercially available clean, fine sand 15 includes the sand product known as AASHTO-A-3 (fine sand according to the grading system of the American Association of State Highway and Transportation Officials. Another sand product that may be useful in certain embodiments is known as USCS-SP (Unified Soil Classification System poorly graded and/or gravelly sand having little or no fine sand).

In embodiments of the present invention, the water 11-drilling mud mixture ratio, sand 15 composition, pumping rates and pressures, and other injection parameters can vary depending on the subsurface area 22 and/or condition to be stabilized.

Figure 5:
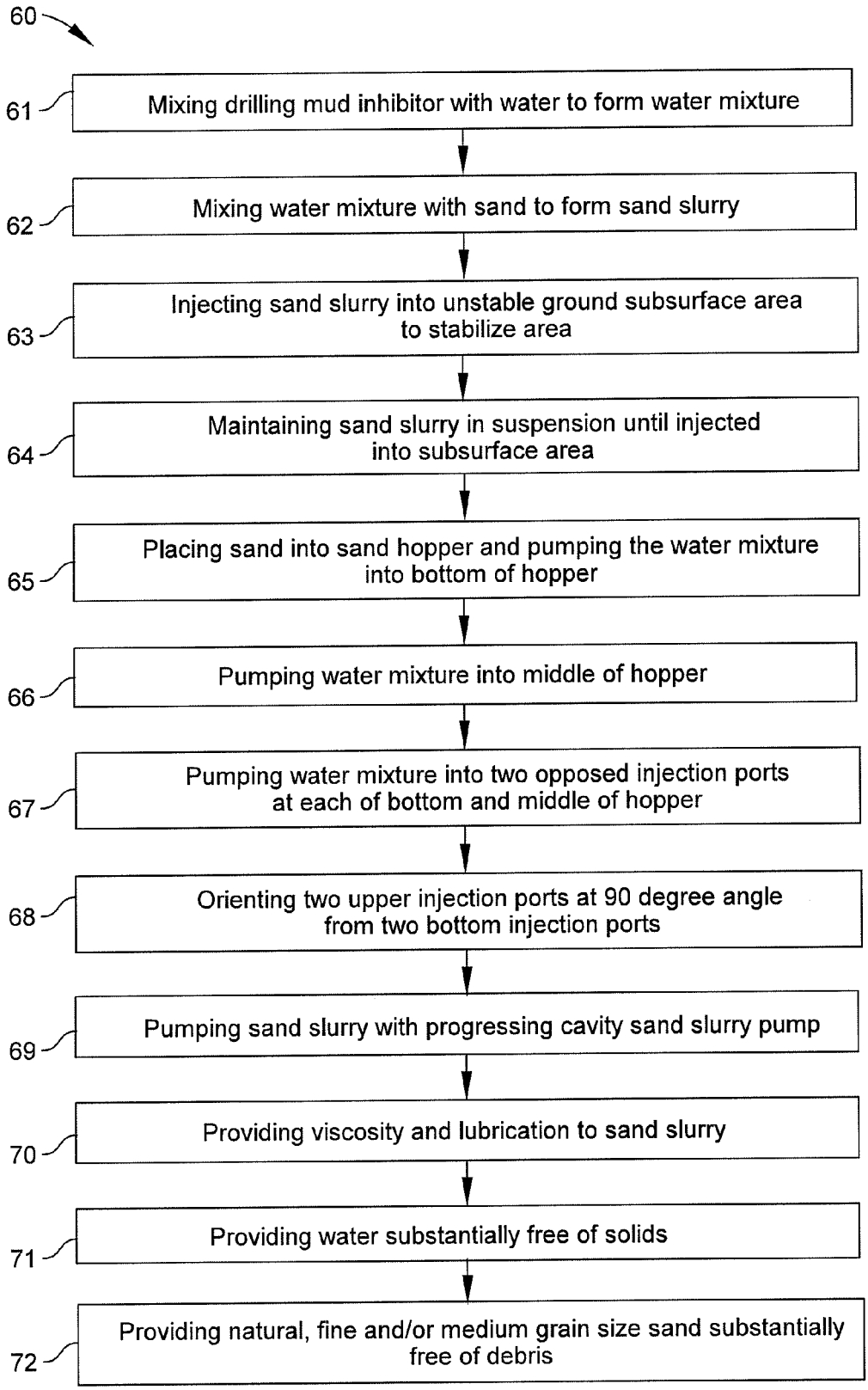
FIG. 5 is a chart illustrating an embodiment of a method of the present invention.

The chart in FIG. 5 illustrates an exemplary embodiment of a method (60) of the present invention. Some embodiments of such a method (60) can be useful in stabilizing the subsurface area 22 utilizing the sand slurry injection system 10. For example, such a method (60) can include mixing (61) a drilling mud inhibitor with water 11 to form a water mixture; mixing (62) the water mixture with sand 15 to form the sand slurry 17; and injecting (63) the sand slurry 17 into the unstable ground subsurface area 22 to stabilize the area 22. The method can further include maintaining (64) the sand slurry 17 in suspension in the hopper 16 until the sand slurry 17 is injected into the unstable ground subsurface area 22. For example, the sand 15 can be placed (65) into the sand hopper 16 and the water mixture pumped under pressure into the bottom 34 of the hopper 16 to help maintain the sand slurry 17 in suspension. Certain embodiments can further include pumping (66) the water mixture under pressure into the middle 36 of the hopper 16. Certain embodiments can further include pumping (67) the water mixture into two opposed injection ports 44, 46 at each of the bottom 34 and the middle 36 of the hopper 16. Particular embodiments can further include orienting (68) the two upper injection ports 46 at a 90 degree angle from the two bottom injection ports 44. Some embodiments can further include injecting, or pumping (69), the sand slurry 17 into the unstable subsurface area 22 with a progressing cavity sand slurry pump 18.

Some embodiments of the method can further include providing (70) viscosity and lubrication to the sand slurry 17. Sand slurry viscosity and lubrication may be enhanced by embodiments of the water—drilling mud inhibitor mixture comprising a high molecular weight polymer emulsion. Certain embodiments of the method can further include providing (71) the water 11 substantially free of solids. Certain embodiments of the method can further include providing (72) the sand 15 as natural, fine and/or medium grain size sand substantially free of debris.

Some embodiments of the sand slurry injection system 10 and/or method 60 can provide for subsurface stabilization having advantages over prior systems and methods, such as concrete grout injection. For example, some embodiments of the present invention can advantageously provide for long term stability to subsurface areas while preserving percolation capacity through the injected areas (especially at the bottom of ponds where percolation is the primary function of the pond). In contrast to conventional concrete grout injection that can create a substantially impervious subsurface condition and thereby undesirably impede pond percolation, subsurface stabilization utilizing embodiments of the sand slurry injection system and/or method 10, 60, respectively, of the present invention can allow normal water seepage through the stabilizing sand slurry.

Another advantage is that some embodiments of the present invention can substantially eliminate the possibility of plugging of production zones and/or transmissive zones around a production well associated with conventional concrete grout injection. Another advantage is that some embodiments of the present invention can avoid "grouting in" of buried utilities or other underground structures as with a concrete grout. Another advantage is that some embodiments of the present invention can allow the injection of a more environmentally sensitive natural material, that is, sand, to repair unstable subsurface conditions, thereby avoiding the introduction of a processed material, such as cement. Another advantage is that some embodiments of the present invention utilize an injection process that is simpler than injection of concrete grout and that can provide cost savings due to utilization of readily available components and natural sand and water to repair underground instabilities.

In addition, accepted approaches to investigate subsurface conditions and establish injection criteria currently used for concrete grout injection can be directly transferred to sand slurry injection systems and methods of the present invention.

Some embodiments of the subsurface sand slurry injection system and method can be particularly useful for subsurface conditions that exhibit voids, fissures, extensive raveling, excessively loose soils (weight-of-rod or weight-or-hammer type conditions), or loss of drilling fluid circulation conditions. That is, due to its relatively low viscosity, the sand slurry 17 has the ability to fill voids and to push into loose, or highly raveled, subsurface conditions. For example, it is believed that some embodiments of the subsurface sand slurry injection system and method can provide sustainable remediation of unstable subsurface conditions including storm water ponds, rapid infiltration basins at waste water treatment plants, buried drainage systems, pumping wells, areas with buried utilities, and collapsed roadways.

Although the present invention has been described with reference to particular embodiments, it should be recognized that these embodiments are merely illustrative of the principles of the present invention. Those of ordinary skill in the art will appreciate that sand slurry injection systems and/or methods of the present invention may be constructed and implemented in other ways and embodiments. Accordingly, the description herein should not be read as limiting the present invention, as other embodiments also fall within the scope of the present invention.

What is claimed is:

1. A method, comprising:

mixing a lubricating drilling mud inhibitor with water to form a water mixture;

mixing the water mixture with sand to form a sand slurry; and injecting the sand slurry into an unstable ground subsurface area to stabilize the area.

2. The method of claim 1, further comprising maintaining the sand slurry in suspension in the hopper until the sand slurry is injected into the unstable ground subsurface area.

3. The method of claim 2, further comprising:

placing the sand into a sand hopper having a top, a bottom, and a middle between the top and bottom; and pumping the water mixture under pressure into the bottom of the hopper.

4. The method of claim 3, further comprising pumping the water mixture under pressure into the middle of the hopper.

5. The method of claim 4, wherein the pumping the water mixture further comprises pumping the water mixture into two opposed injection ports at each of the bottom and the middle of the hopper.

6. The method of claim 5, further comprising orienting the two upper injection ports at a 90 degree angle from the two bottom injection ports.

7. The method of claim 1, wherein the injecting the sand slurry further comprises pumping the sand slurry with a progressing cavity sand slurry pump.

8. The method of claim 1, wherein the mixing a drilling mud inhibitor with water further comprises providing viscosity and lubrication to the sand slurry.

9. The method of claim 1, further comprising providing the water substantially free of solids.

10. The method of claim 1, further comprising providing natural, fine and/or medium grain size sand substantially free of debris.

11. The method of claim 1, wherein the sand comprises sand grains of which by weight:

(a) about 100% have a diameter of less than 4.76 mm;

(b) about 95% to about 100% have a diameter of less than 0.59 mm;

(c) about 10% to about 60% have a diameter of less than 0.297 mm;

(d) about 0% to about 8% have a diameter of less than 0.149 mm; and (e) about 0% to about 5% have a diameter of less than 0.074 mm.

12. A system, comprising:

a water mixture comprising a lubricating drilling mud inhibitor mixed with water;

a water pump adapted to pump the water mixture under pressure into a sand hopper containing sand to form a sand slurry, the sand hopper further comprising a top, a bottom, a middle between the top and bottom, two opposed injection ports at the bottom of the hopper, and two opposed injection ports at the middle of the hopper, each injection port configured to receive the pressurized water mixture; and a sand slurry pump adapted to pump the sand slurry under pressure into an unstable ground subsurface area to stabilize the area.

13. The system of claim 12, wherein the sand comprises sand grains of which by weight:

(a) about 100% have a diameter of less than 4.76 mm;

(b) about 95% to about 100% have a diameter of less than 0.59 mm;

(c) about 10% to about 60% have a diameter of less than 0.297 mm;

(d) about 0% to about 8% have a diameter of less than 0.149 mm; and (e) about 0% to about 5% have a diameter of less than 0.074 mm.

14. The system of claim 12 wherein the two opposed injection ports at the middle of the hopper are oriented at a 90 degree angle from the two opposed injection ports at the bottom of the hopper.

15. The system of claim 12, wherein the sand slurry pump further comprises a progressing cavity pump.

16. The system of claim 12, wherein the drilling mud inhibitor comprises a high molecular weight polymer emulsion, and wherein the water mixture further comprises increased viscosity and lubrication impartable to the sand slurry.

17. The system of claim 12, wherein the water is substantially free of solids.

18. The system of claim 12, wherein the sand comprises natural, fine and/or medium grain size sand substantially free of debris.

19. The system of claim 12, wherein the sand hopper further comprises:

an approximately four foot by four foot, substantially square top;

four sides extending from the top and angled inwardly to a bottom in a funnel shape;

an approximately four inch by four inch, substantially square bottom outlet; and a hopper delivery pipe connected on one end to the bottom outlet and connectable on the other end to the sand slurry pump.

20. The system of claim 19, further comprising a bottom frame attached to the bottom of the sand hopper, thereby providing a space for the hopper delivery pipe.

21. The system of claim 12, further comprising a high pressure hose securely connectable from the sand slurry pump to a subsurface delivery pipe configured to deliver the sand slurry to the unstable ground subsurface area.

* * * * *